US011589729B2

(12) United States Patent
Ohayon et al.

(10) Patent No.: US 11,589,729 B2
(45) Date of Patent: Feb. 28, 2023

(54) ARTICLE HOLDER ASSEMBLY FOR A DISHWASHER APPLIANCE

(71) Applicant: Haier US Appliance Solutions, Inc., Wilmington, DE (US)

(72) Inventors: Tal Abraham Ohayon, Louisville, KY (US); Brian Steven Riddle, Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 67 days.

(21) Appl. No.: 17/114,031

(22) Filed: Dec. 7, 2020

(65) Prior Publication Data

US 2022/0175215 A1 Jun. 9, 2022

(51) Int. Cl.
*A47L 15/50* (2006.01)

(52) U.S. Cl.
CPC ..... *A47L 15/503* (2013.01); *A47L 15/502* (2013.01); *A47L 15/504* (2013.01); *A47L 15/505* (2013.01)

(58) Field of Classification Search
CPC .... A47L 15/502; A47L 15/503; A47L 15/504; A47L 15/505
See application file for complete search history.

(56) References Cited

U.S. PATENT DOCUMENTS 3,752,322 A * 8/1973 Fiocca ..... A47L 15/505 211/41.8
4,917,248 A * 4/1990 Friskney ..... A47L 15/503 211/184
6,325,220 B1 * 12/2001 Malmstrom ..... A47L 15/503 211/41.9
7,458,471 B2 12/2008 Crudgington, Jr.
7,644,826 B2 * 1/2010 Koch ..... A47L 15/503 211/41.4

(Continued)

FOREIGN PATENT DOCUMENTS

CH 694033 A5 * 6/2004 ..... A47L 15/503
CN 108095655 A 6/2018

(Continued)

OTHER PUBLICATIONS

MIele G641 Dishwasher Overview (https://www.manualslib.com/manual/528161/Miele-G-641.html) (Year: 2014).*

*Primary Examiner* — Joseph L. Perrin
*Assistant Examiner* — Irina Graf
(74) *Attorney, Agent, or Firm* — Dority & Manning, P.A.

(57) ABSTRACT

An article holder assembly for use in a dishwasher appliance includes a first attachment arm for securing to a first side wall of a rack of the dishwasher appliance, a second attachment arm for securing to an opposing, second side wall of a rack of the dishwasher appliance, and at least one article positioning arm secured between the first and second attachment arms. The article positioning arm(s) is movable between an engaged position and a disengaged position. Thus, the article positioning arm(s) defines a predefined geometry configured to receive a portion of one or more articles for cleaning in the dishwasher appliance. Further, when the article positioning arm(s) is in the engaged position, the predefined geometry positions and secures one or more of the articles on a rack of the dishwasher appliance for cleaning.

17 Claims, 9 Drawing Sheets

(56) References Cited

U.S. PATENT DOCUMENTS

| | | | | |
|---|---|---|---|---|
| 8,651,287 | B2 * | 2/2014 | Moser | A47L 15/503 211/195 |
| 10,052,012 | B2 | 8/2018 | Mesa et al. | |
| 10,159,397 | B2 | 12/2018 | Citak et al. | |
| 10,368,718 | B2 | 8/2019 | Wilson et al. | |
| 10,405,731 | B2 | 9/2019 | Harr | |
| 10,463,226 | B2 | 11/2019 | Mesa et al. | |

FOREIGN PATENT DOCUMENTS

| | | | | | |
|---|---|---|---|---|---|
| CN | 110101347 | A | | 8/2019 | |
| CN | 105534462 | B | | 12/2019 | |
| CN | 110881920 | A | | 3/2020 | |
| DE | 10106763 | A1 | | 8/2002 | |
| EP | 1199025 | A1 | * | 4/2002 | A47L 15/503 |
| EP | 2151181 | A1 | * | 2/2010 | A47L 15/502 |
| EP | 1929928 | B1 | | 2/2012 | |
| EP | 2798996 | B1 | | 8/2015 | |
| EP | 3164045 | B1 | | 8/2018 | |
| FR | 2915364 | A1 | * | 10/2008 | A47L 15/505 |
| GB | 1393054 | A | | 5/1975 | |
| KR | 20060095354 | A | * | 8/2006 | A47L 15/505 |
| WO | WO-2006042594 | A1 | * | 4/2006 | A47L 15/503 |
| WO | WO-2008061898 | A1 | * | 5/2008 | A47L 15/503 |
| WO | WO2013/045543 | A1 | | 4/2013 | |
| WO | WO-2015000508 | A1 | * | 1/2015 | A47L 15/503 |

* cited by examiner

ARTICLE HOLDER ASSEMBLY FOR A DISHWASHER APPLIANCE

FIELD OF THE INVENTION

The present subject matter relates generally to dishwasher appliances and, in particular, to an article holder assembly for a dishwasher appliance.

BACKGROUND OF THE INVENTION

Dishwasher appliances generally include a tub that defines a wash chamber. Dishwasher appliances also generally include a rack assembly mounted within the wash chamber. The rack assembly is configured for receipt of articles for washing. For example, a user can slide the rack assembly out of the wash chamber and load plates, bowls, cups, or any suitable article or combination of articles into the rack assembly. After loading is complete, the user may slide the rack assembly back into the wash chamber.

In particular, the user can slide the rack assembly is to a retracted position. During operation of the dishwasher appliance, such a configuration for the rack assembly is preferable and may be required for certain dishwasher appliance components to function properly. Further, certain dishwasher appliances include a spray assembly mounted to the rack assembly. The spray assembly is normally configured such that the rack assembly must be positioned in the retracted position for the spray assembly to receive wash fluid during operation of the dishwasher appliance. The rack assembly may include, for example, top and bottom racks or top, middle, and bottom racks.

In certain dishwasher appliances, the top rack assembly may include a stemware holder on either side thereof. However, the top rack places stringent height restrictions on stemware and other tall articles placed therein. Furthermore, with the addition of a middle rack, such height restrictions are even more stringent.

Accordingly, an article holder assembly for a dishwasher appliance that addresses the aforementioned issues would be useful. Thus, the present disclosure is directed to an article holder assembly for use in the lower rack that can be placed atop the silverware cleaning system such that taller articles can be placed therein and which also has better wash performance.

BRIEF DESCRIPTION OF THE INVENTION

Aspects and advantages of the invention will be set forth in part in the following description, or may be obvious from the description, or may be learned through practice of the invention.

In an aspect, the present disclosure is directed to a dishwasher appliance having a tub that defines a wash chamber. The dishwasher appliance also includes a door mounted proximate the tub and permits selective access to the wash chamber of the tub. Further, the dishwasher appliance includes a rack assembly mounted within the wash chamber and configured for receipt of articles for cleaning. The rack assembly includes an upper rack and a lower rack. Moreover, the dishwasher appliance includes an article holder assembly having at least one attachment arm secured to a side wall of the lower rack and at least one article positioning arm secured to the attachment arm(s). The article positioning arm(s) is movable between an engaged position and a disengaged position. Thus, the article positioning arm(s) defines a predefined geometry configured to receive a portion of one or more of the articles for cleaning. Further, when the article positioning arm(s) is in the engaged position, the predefined geometry positions and secures one or more of the articles for cleaning.

In another aspect, the present disclosure is directed to an article holder assembly for use in a dishwasher appliance. The article holder assembly includes a first attachment arm for securing to a first side wall of a rack of the dishwasher appliance, a second attachment arm for securing to an opposing, second side wall of a rack of the dishwasher appliance, and at least one article positioning arm secured between the first and second attachment arms. The article positioning arm(s) is movable between an engaged position and a disengaged position. Thus, the article positioning arm(s) defines a predefined geometry configured to receive a portion of one or more articles for cleaning in the dishwasher appliance. Further, when the article positioning arm(s) is in the engaged position, the predefined geometry positions and secures one or more of the articles on a rack of the dishwasher appliance for cleaning.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
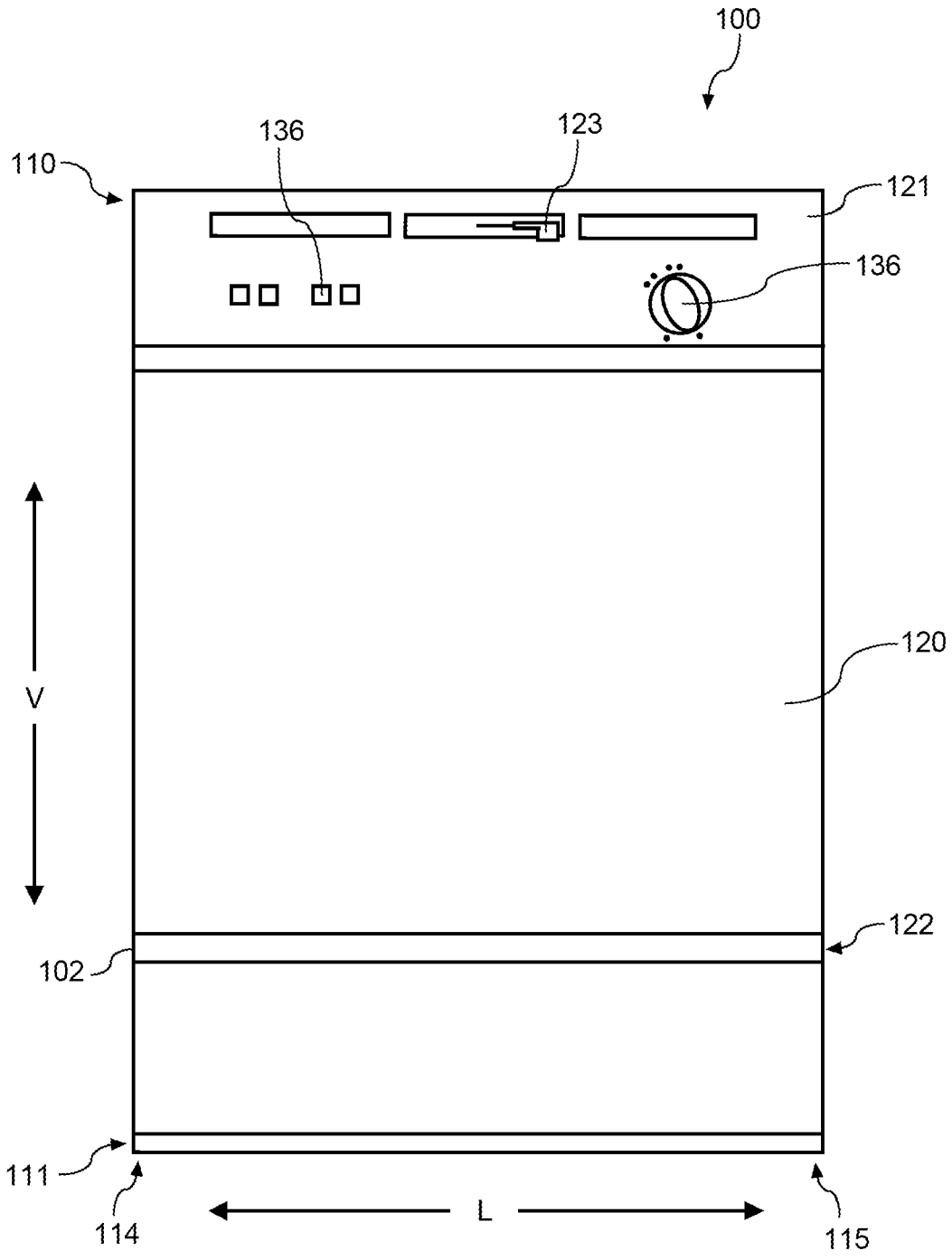
FIG. 1 provides a front view of a dishwasher appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
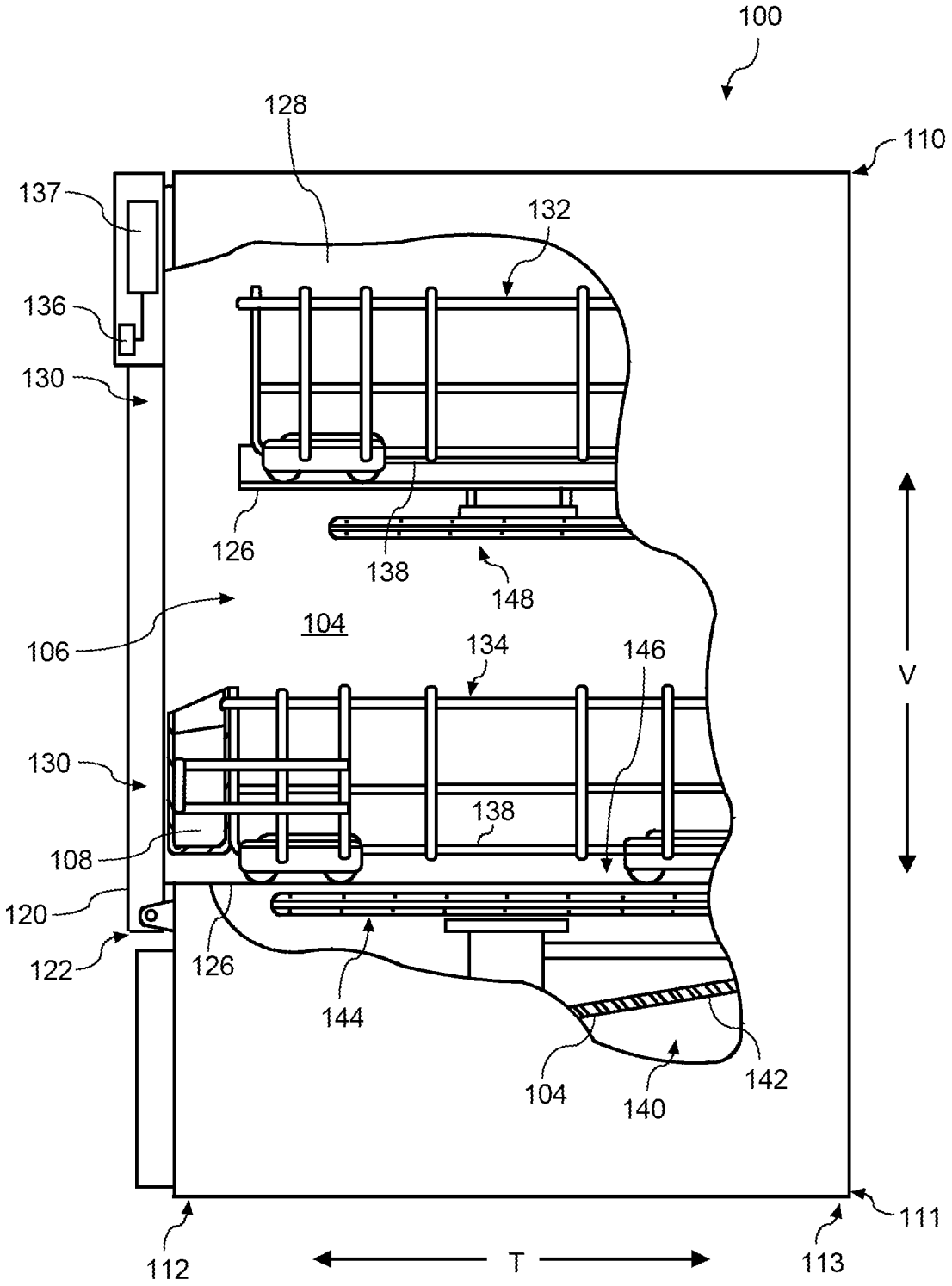
FIG. 2 provides a side view of the dishwasher appliance of FIG. 1 with portions of a cabinet of the dishwasher appliance removed to reveal an interior of the dishwasher appliance.

Referring now to the drawings, FIGS. 1 and 2 depict an exemplary dishwasher appliance 100 that may be configured in accordance with aspects of the present disclosure. The dishwasher appliance 100 includes a cabinet 102 having a tub 104 (FIG. 2) therein that defines a wash chamber 106 (FIG. 2). The tub 104 includes a door 120 hinged at its bottom 122 for movement between a normally closed configuration that is shown in FIGS. 1 and 2, wherein the wash chamber 106 is sealed shut, e.g., during dishwasher appliance 100 operation, and an open configuration, e.g., for loading and unloading of articles from the dishwasher appliance 100. A latch 123 (FIG. 1) is used to lock and unlock the door 120 for access to wash chamber 106.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

As shown in FIG. 2, guide rails 126 are mounted on tub sidewalls 128 and accommodate a rack assembly 130, e.g. having upper and lower roller-equipped racks 132, 134. Each of the upper and lower racks 132, 134 is fabricated from lattice structures that include a plurality of elongated members 138. Each rack 132, 134 is adapted for movement between an extended loading position (not shown) in which the rack is substantially positioned outside the wash chamber 106, and a retracted position (shown in FIGS. 1 and 2) in which the rack is located inside the wash chamber 106.

A silverware basket 108 is removably mounted to the lower rack 134. However, silverware basket 108 may also be selectively attached to other portions of dishwasher appliance 100, e.g., the upper rack 132 or the door 120. The silverware basket 108 is configured for receipt of silverware, utensils, and the like (e.g., spoons, forks, and/or knives) that are too small to be accommodated by the upper and lower racks 132, 134. Further, the silverware basket 108 may be constructed of any suitable material, e.g., metal or plastic, and is discussed in greater detail below.

The dishwasher appliance 100 further includes a lower spray assembly 144 that is mounted within a lower region 146 of the wash chamber 106 and above a tub sump portion 142 so as to be positioned in relatively close proximity to lower rack 134. A mid-level spray assembly 148 is located in an upper region of the wash chamber 106 and may be located in close proximity to upper rack 132. In particular, mid-level spray assembly 148 may be mounted to upper rack 132 as discussed in greater detail below.

The spray assemblies 144, 148 are fed by a fluid circulation assembly (not shown) for circulating water and wash fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the rack assembly 130 and the silverware basket 108. The arrangement of the discharge ports in at least the lower spray assembly 144 provides a rotational force by virtue of washing fluid flowing through the discharge ports. The resultant rotation of the lower spray assembly 144 provides coverage of dishes and other dishwasher contents with a washing spray.

The dishwasher appliance 100 is further equipped with a controller 137 to regulate operation of the dishwasher appliance 100. The controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 137 may be positioned in a variety of locations throughout dishwasher appliance 100. In the illustrated exemplary embodiment, the controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one exemplary embodiment, the user interface panel 136 may represent a general purpose I/O ("GPIO") device or functional block. In one exemplary embodiment, the user interface panel 136 may include input components, such as one or more of a variety of electrical, mechanical or electro-mechanical input devices including rotary dials, push buttons, and touch pads. The user interface panel 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that the exemplary embodiment depicted in FIGS. 1 and 2 is for illustrative purposes only. For example, the present subject matter may be used in dishwasher appliances having other rack configurations.

Figure 3:
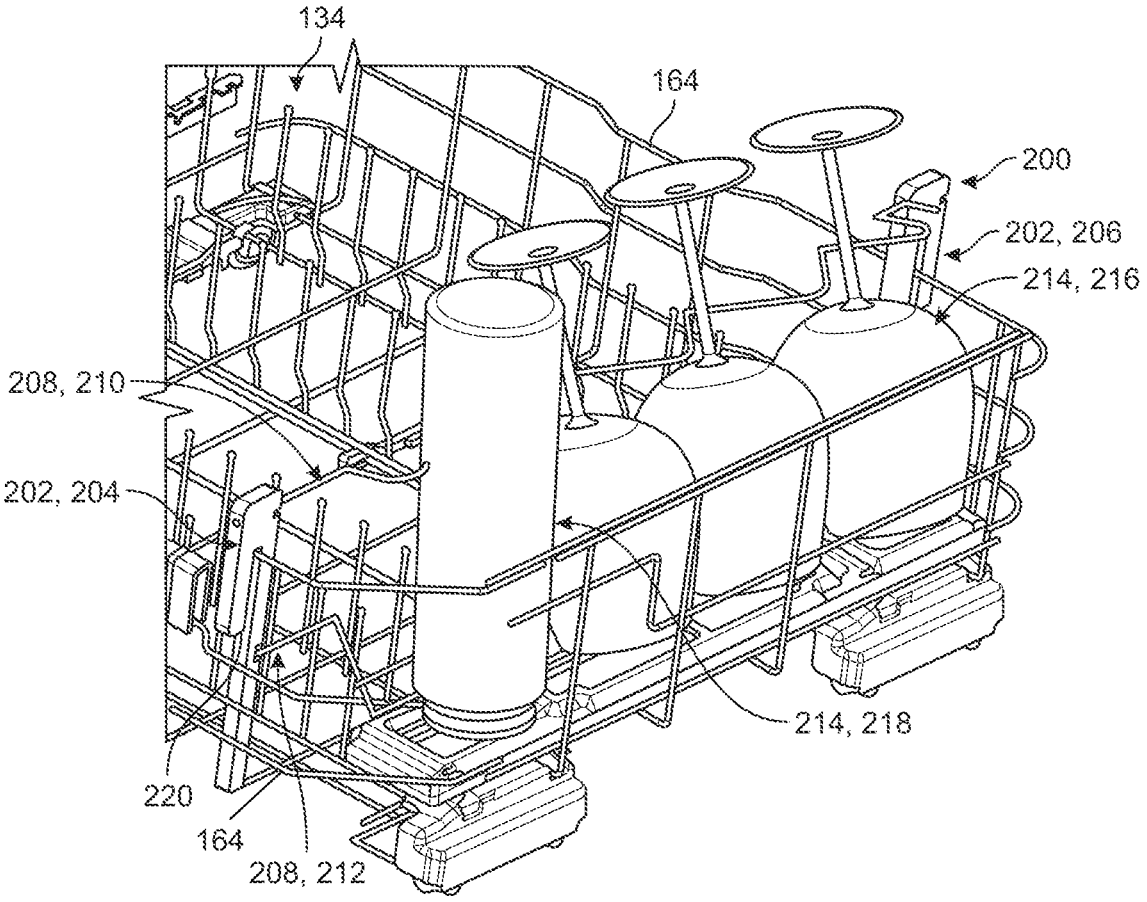
FIG. 3 illustrates a partial, perspective view of a rack assembly and an article holder assembly according to an exemplary embodiment of the present subject matter, particularly illustrating articles positioned in the article holder assembly.
Figure 4A:
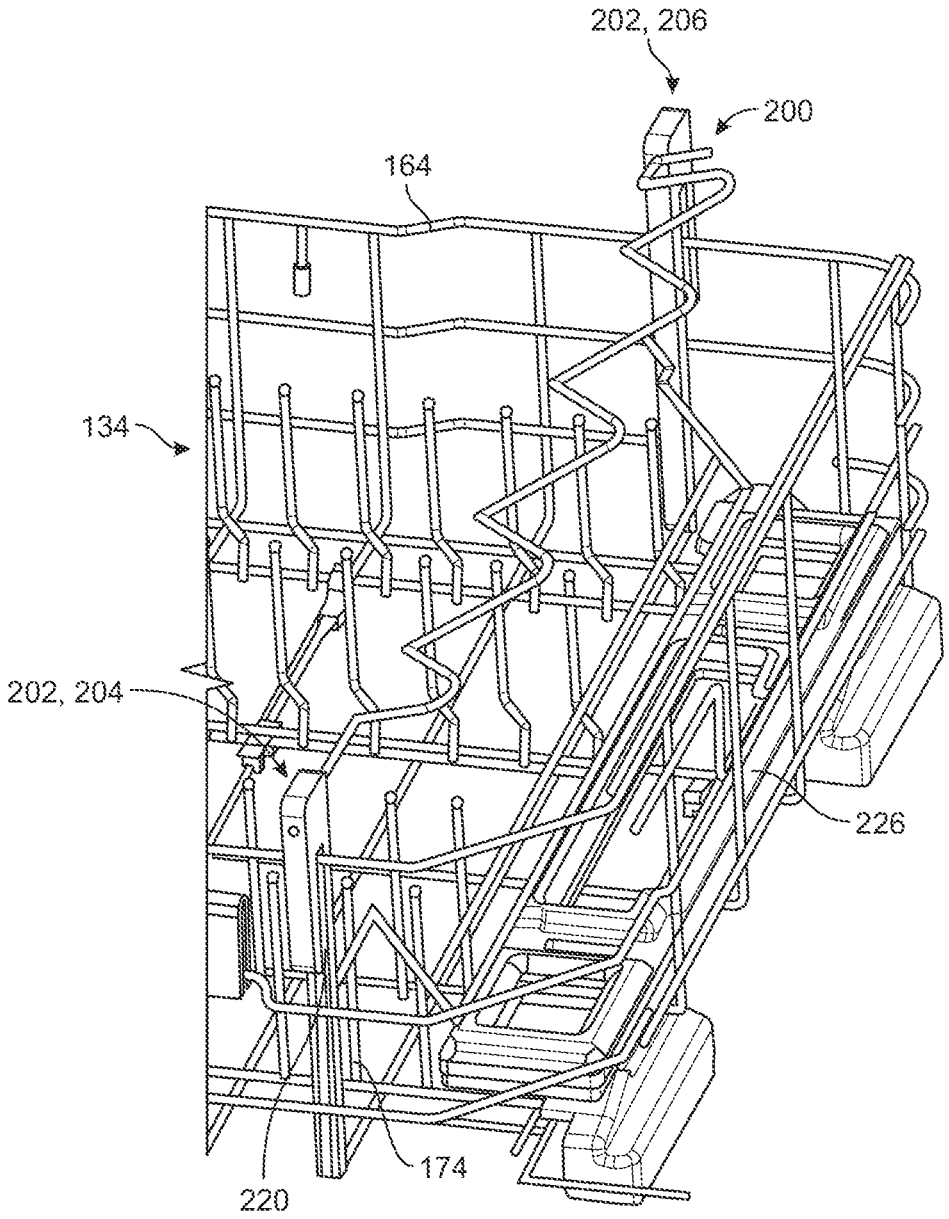
FIG. 4A illustrates a partial, perspective view of a rack assembly and an article holder assembly according to an exemplary embodiment of the present subject matter, particularly illustrating the article holder assembly in an engaged position.
Figure 4B:
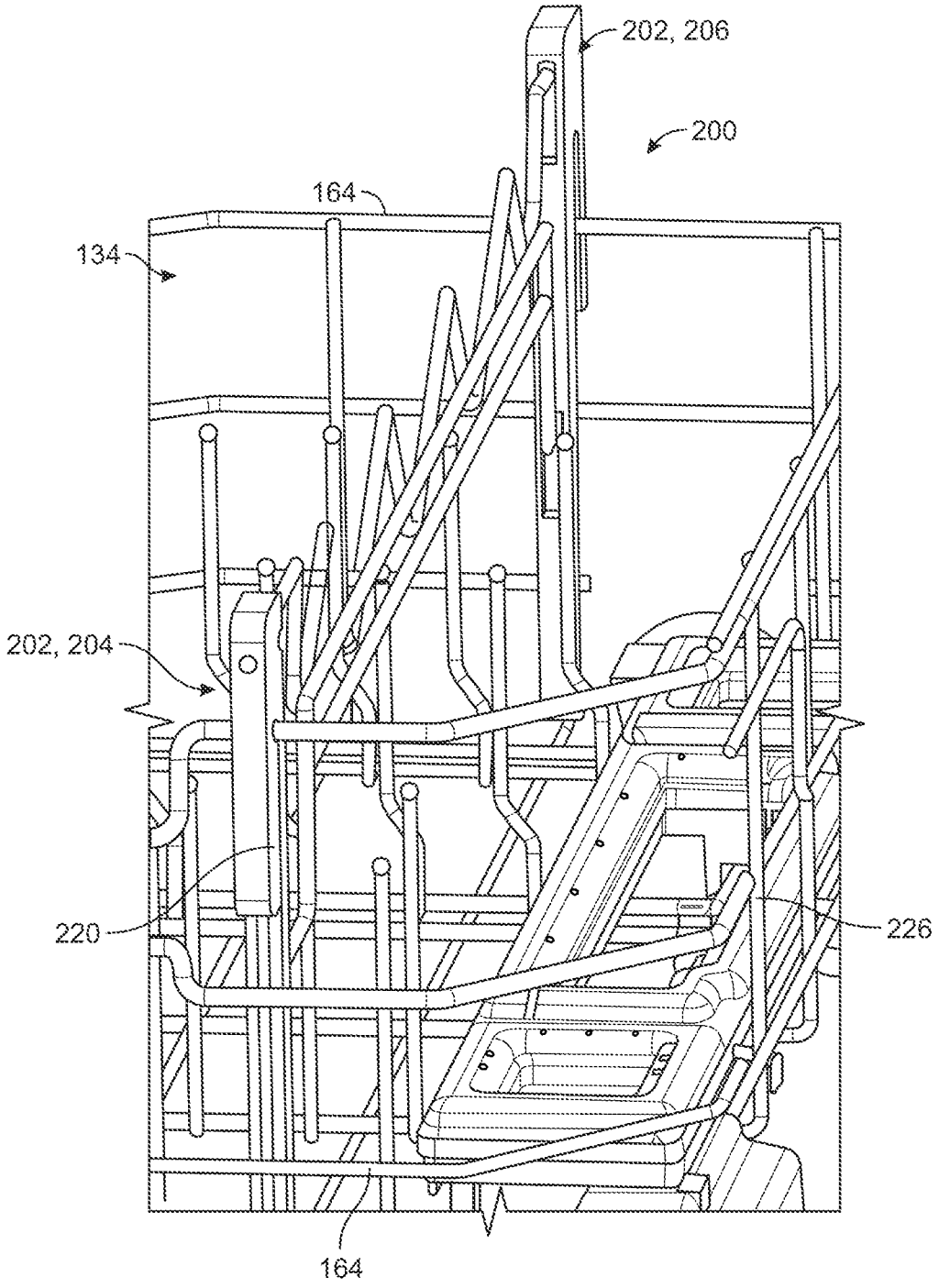
FIG. 4B illustrates a partial, perspective view of a rack assembly and an article holder assembly according to an exemplary embodiment of the present subject matter, particularly illustrating the article holder assembly in a disengaged position.

Referring now to FIGS. 3, 4A, and 4B, partial, perspective views of the lower rack 134 with the silverware basket 108 removed from dishwasher appliance 100 is illustrated. As shown, the lower rack 134 is generally configured as a basket-like structure having a bottom wall 162 and a front wall 150 and sidewalls 164 that extends upwardly from the bottom wall 162 along the vertical direction V. Front wall 150 extends along the lateral direction L in order to extend between and connect sidewalls 164. Front wall 150 and sidewalls 164 form corners 190 where front wall 150 meets sidewalls 164.

As discussed above, the lower rack 134 is formed from plurality of elongated members 138. Thus, bottom wall 162, front wall 150, and sidewalls 164 may be formed with wire or rod members into an open lattice structure. For example, the bottom wall 162 may be defined by a plurality of longitudinal rods 172 that are crossed with a plurality of lateral rods 170, as generally known in the art. Rods 170, 172 may be connected together by any suitable means, including welding, epoxy, clips, and so forth. A plurality of fixed tines 174 project vertically upward from bottom wall 162 and from any combination of the rods 170, 172. Accordingly, the rack assembly 130 is configured for receiving articles 214 for cleaning.

Referring generally to FIGS. 3-9, the dishwasher appliance 100 also includes an article holder assembly 200. In particular, FIGS. 3-9 illustrate various views of one embodiment of the article holder assembly 200 according to the present disclosure. More specifically, as shown, the article holder assembly 200 has at least one attachment arm 202 secured to one of the side walls 164 of the lower rack 134. In particular, as shown in FIGS. 3, 4A, and 4B, the article holder assembly 200 has a first attachment arm 204 and a second attachment arm 206 that are secured to opposing side walls 164 of the lower rack 134. For example, in certain embodiments, as shown in FIGS. 3, 4A, 4B, 6, 7A, and 9, top ends 222 of the first and second attachment arms 204, 206 may include a slot 220 configured for sliding onto the opposing side walls 164 of the lower rack 134 so as to assist with securing the first and second attachment arms 204, 206 in place.

Figure 8:
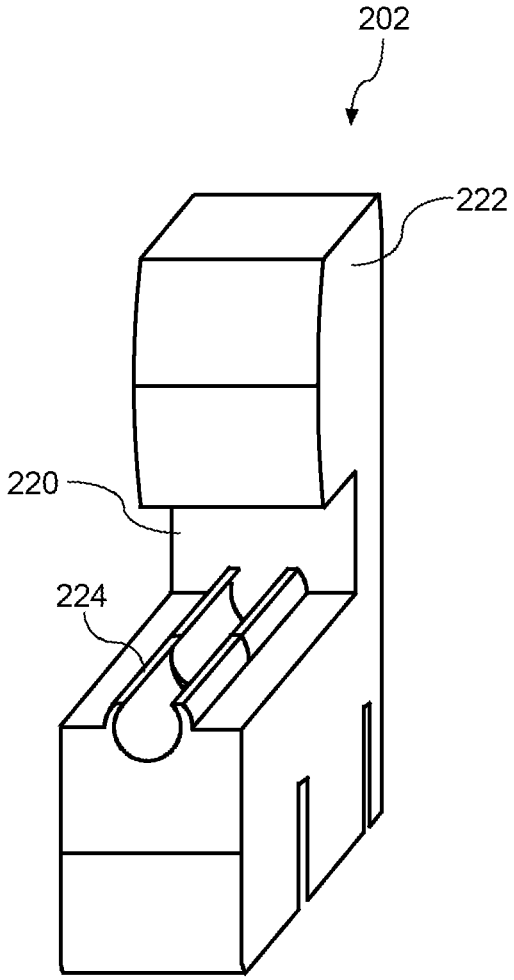
FIG. 8 illustrates a bottom view of an attachment arm of an article holder assembly according to an exemplary embodiment of the present subject matter.
Figure 9:
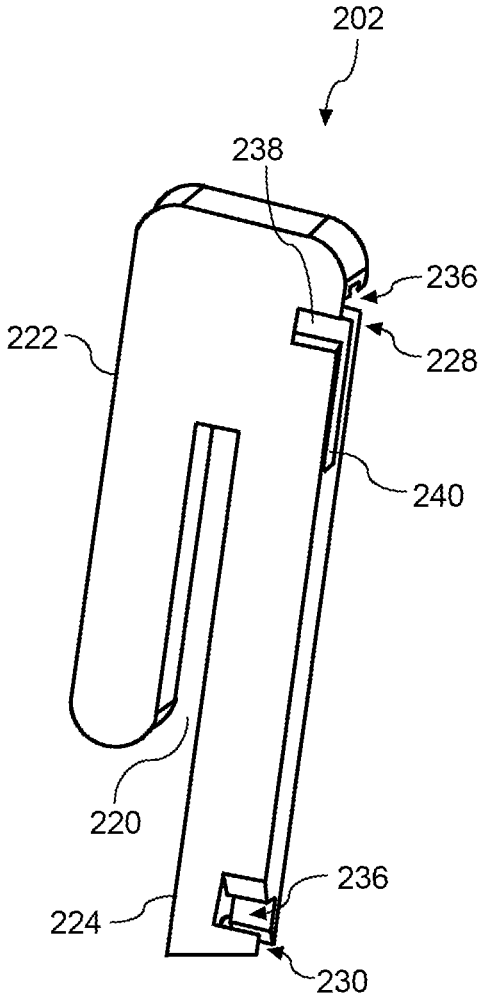
FIG. 9 illustrates a partial, perspective view of a top portion of an attachment arm of an article holder assembly according to an exemplary embodiment of the present subject matter.

In addition, as shown particularly in FIG. 8, the first and second attachment arms 204, 206 may also include a female connector 224 or cavity configured for receiving at least one of the tines 174 of the lower rack 164 (as shown in FIGS. 4A and 4B) so as to further assist with securing the first and second attachment arms 204, 206 in place.

Figure 5A:
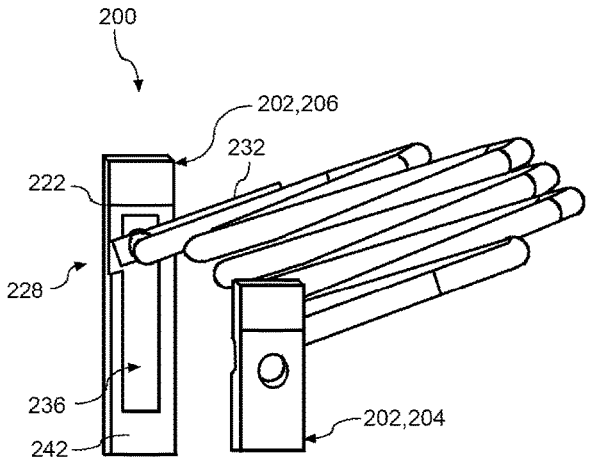
FIG. 5A illustrates a partial, perspective view of an article holder assembly according to an exemplary embodiment of the present subject matter, particularly illustrating the article holder assembly in an engaged position.
Figure 5B:
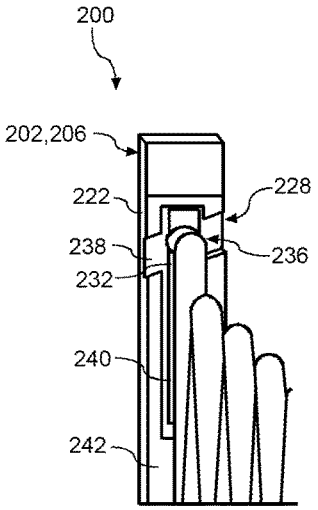
FIG. 5B illustrates a partial, perspective view of an article holder assembly according to an exemplary embodiment of the present subject matter, particularly illustrating the article holder assembly in a disengaged position.
Figure 6:
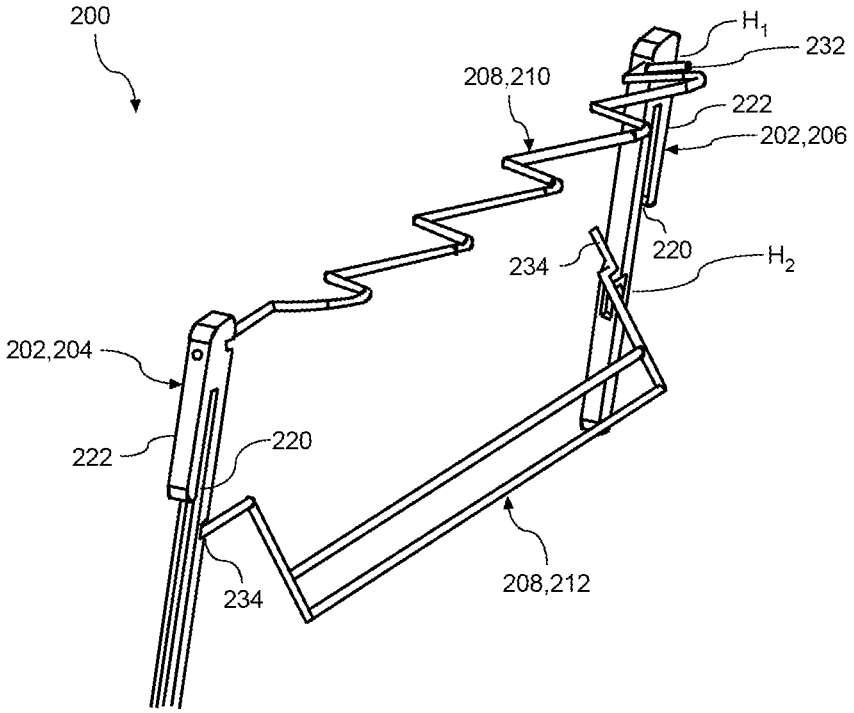
FIG. 6 illustrates a perspective view of an article holder assembly according to an exemplary embodiment of the present subject matter.
Figure 7A:
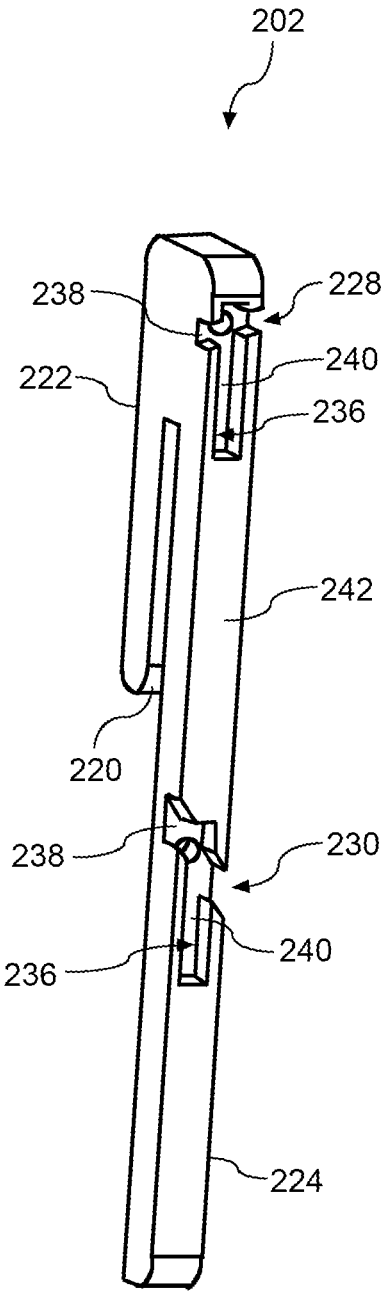
FIG. 7A illustrates a perspective view of an attachment arm of an article holder assembly according to an exemplary embodiment of the present subject matter.
Figure 7B:
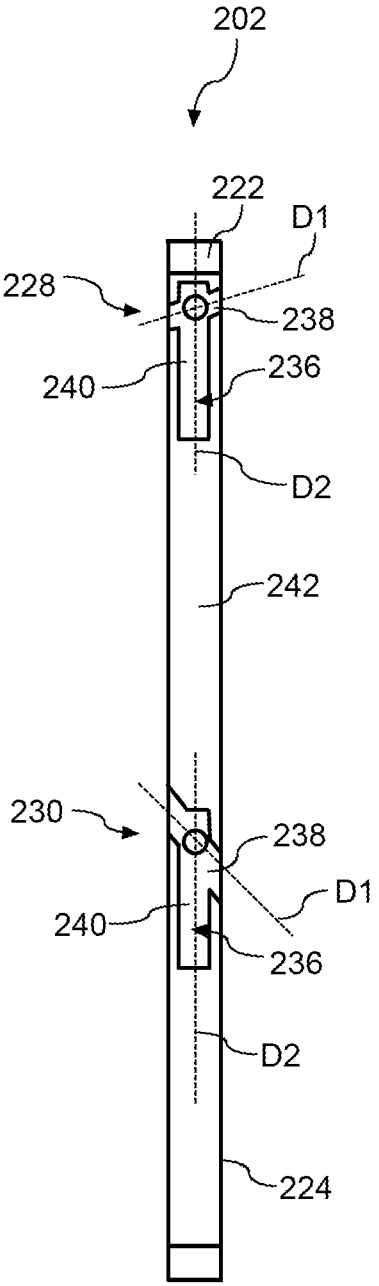
FIG. 7B illustrates a front view of an attachment arm of an article holder assembly according to an exemplary embodiment of the present subject matter.

Furthermore, the article holder assembly 200 has at least one article positioning arm 208 secured between the first and second attachment arms 204, 206. More specifically, as shown in FIGS. 3, 4A, 4B, and 6, the article holder assembly 200 may include a first positioning arm 210 and a second positioning arm 212. Moreover, as shown, the first and second article positioning arms 210, 212 are movable between an engaged position (FIGS. 3, 4A, and 5A) and a disengaged position (FIGS. 4B and 5B). For example, in certain embodiments, as shown particularly in FIG. 6, the first and second positioning arms 210, 212 may be rotatably mounted between the first and second attachment arms 204, 206 at a first height $H_1$ and a lower, second height $H_2$, respectively.

In addition, as shown particularly in FIGS. 3, 4A, 4B, 5A, 5B, and 6, the first positioning arm 210 may define a predefined geometry configured to receive a portion of one or more of the articles 214 for cleaning. Thus, when the article positioning arm(s) 208 is in the engaged position, the predefined geometry positions and secures one or more of the articles 214 for cleaning. For example, as shown in the illustrated embodiment, the first and second article positioning arms 210, 212 may be formed of a flexible wire form. More specifically, as shown in the illustrated embodiment of FIG. 6, the first article positioning arm 210 defines a wire form having one or more notches 244 for receiving the articles. Such notches 227, for example, may be V-shaped, U-shaped, etc. for receiving varying types of articles 214, such as stems of stemware 216, water bottles 218, etc. Further, as shown, the second article positioning 212 may define a wire form having any suitable shape that assists with maintaining the articles 214 in a desired position during cleaning. Thus, in certain embodiments, in the engaged position, the first article positioning arm 210 orients the articles 214 (e.g. stemware 216, water bottles 218, etc.) in a direction away from the side wall 164 of the lower rack 134 such that fluid does not pool atop the base of the articles 214 during operation of the dishwasher appliance 100. In such embodiments, as shown in FIG. 3, the article holder assembly 200 orients the articles 214 at an angle with respect to the side wall 164. In particular embodiments, the angle may range up to about 60 degrees.

Referring particularly to FIGS. 5A, 5B, 7A, and 7B, the first and second attachment arms 204, 206 each include an attachment location 228, 230 at each of the first and second heights $H_1$ and $H_2$, respectively, for respective end portions 232, 234 (FIG. 6) of the first and second article positioning arms 210, 212. Further, as shown, each of the attachment locations 228, 230 includes a recess 236 formed into an inner surface 242 of the first and second attachment arms 204, 206 at the first and second heights $H_1$ and $H_2$, respectively. More specifically, as shown, each of the recesses 236 includes a first cutout 238 extending in a first direction and a second cutout 240 extending in a second direction. Further, as shown, the first and second directions may be different. As particularly shown in FIG. 7B, the first direction $D_1$ may extend at an angle with respect to the second direction $D_2$. Further, upper first cutouts 238 may extend at a different angle than the lower first cutouts 238 or at the same angle. Moreover, as shown, the first cutout 238 of each recess 236 intersects the second cutout 240 of each recess 236.

Thus, in the engaged position, as shown particularly in FIGS. 3, 4A, 5A and 6, the respective end portions 232, 234 of the first and second article positioning arms 210, 212 are secured in placed via the first cutouts 238. Further, in the disengaged position, as shown in FIGS. 4B and 5B, the respective end portions 232, 234 of the first and second article positioning arms 210, 212 are secured in placed via the second cutouts 240.

Accordingly, in certain embodiments, to move either of the first and second article positioning arms 210, 212 to the engaged position, a user simply needs to compress and rotate the respective wire form until the respective end portions (e.g. either end portions 232 or 234) thereof align with the first cutouts 238. Then, the compressed wire forms can be released, thereby securing the respective end portions of one of the article positioning arm 210, 212 within the first cutouts 238. Similarly, to move either of the first and second article positioning arms 210, 212 to the disengaged position, a user simply needs to compress and rotate the respective wire form until the respective end portions (e.g. either end portions 232 or 234) thereof align with the second cutouts 240. Then, the compressed wire form can be released, thereby securing the respective end portions of the one of article positioning arms 210, 212 within the second cutouts 240. Accordingly, as shown in FIGS. 4B and 5B, when in the disengaged position, the first and second article positioning arms 210, 212 extend in a direction that is generally parallel with the first and second attachment arms 204, 206 such that the first and second article positioning arms 210, 212 and the first and second attachment arms 204, 206 extend in a common two-dimensional plane.

In further embodiments, as shown in FIGS. 4A and 4B, the dishwasher appliance 100 may also include a silverware cleaning system 226 positioned adjacent to the lower rack 134. In such embodiments, as shown, the article holder assembly 200 may be positioned adjacent to the silverware cleaning system 226 or silverware blaster manifold. As such, when the first and second attachment arms 204, 206 are secured to the opposing side walls 164 of the lower rack 134, the first and second positioning arms 210, 212 position and secure one or more of the articles 214 above the silverware cleaning system 226 during cleaning. Thus, in such embodiments, the silverware cleaning system 220 is configured to provide an improved wash performance to the articles in the article holder assembly 200 due to dedicated jets concentrated in this region.

Moreover, in certain embodiments, the first and second attachment arms 204, 206 and the first and second article positioning arms 210, 212 described herein may be constructed of the same materials or different materials. For example, in one embodiment, the first and second attachment arms 204, 206 may be constructed of a polymer material, whereas the first and second article positioning arms 210, 212 may be constructed of a metal material. Thus, in such embodiments, the first and second attachment arms 204, 206 can be press-fit onto the side wall 164 of the lower rack 134. In further embodiments, the first and second attachment arms 204, 206 can be secured to the lower rack 134 by any suitable means, including welding, epoxy, clips, and so forth. Furthermore, by constructing the first and second article positioning arms 210, 212 of metal, such components can be easily formed into a wire form having any suitable shape.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a door mounted proximate said tub and permitting selective access to the wash chamber of the tub;

a rack assembly mounted within the wash chamber and configured for receipt of articles for cleaning, the rack assembly comprising an upper rack and a lower rack; and an article holder assembly comprising first and second attachment arms secured to opposing side walls of the lower rack and first and second article positioning arms secured between the first and second attachment arms, the first and second article positioning arms being movable between an engaged position and a disengaged position, the first and second attachment arms each comprising attachment locations for the first and second article positioning arms, each attachment location for the first article positioning arm comprising a first recess formed into an inner surface of one of the first and second attachment arms at a first height, each attachment location for the second article positioning arm comprising a second recess formed into the inner surface of one of the first and second attachment arms at a second height, the first and second recesses each comprising a first cutout extending in a first direction and a second cutout connected to the first cutout and extending in a second direction, the first and second directions being different, wherein the first and second article positioning arms each define a predefined geometry configured to receive a portion of one or more of the articles for cleaning, and wherein, when the first and second article positioning arms are in the engaged position, the predefined geometries position and secure one or more of the articles for cleaning, and wherein, in the engaged position, end portions of the first and second article positioning arms are secured in place via the first cutouts of the first and second attachment arms, and wherein, in the disengaged position, the end portions of the first and second article positioning arms are secured in place via the second cutouts of the first and second attachment arms, and wherein, when in the disengaged position, the first and second article positioning arms extend in a direction that is generally parallel with the first and second attachment arms such that the first and second article positioning arms and the first and second attachment arms extend in a common two-dimensional plane.

2. The dishwasher appliance of claim 1, wherein top ends of the first and second attachment arms each comprise a slot configured for sliding onto the opposing side walls of the lower rack so as to assist with securing the first and second attachment arms in place.

3. The dishwasher appliance of claim 1, wherein bottom ends of the first and second attachment arms each comprise a female connector configured for securing the first and second attachment arms in place.

4. The dishwasher appliance of claim 1, wherein the first and second article positioning arms are rotatably mounted between the first and second attachment arms at the first height and the lower, second height, respectively.

5. The dishwasher appliance of claim 4, further comprising a silverware cleaning system positioned on the lower rack, wherein the first and second article positioning arms position and secure one or more of the articles above the silverware cleaning system during cleaning.

6. The dishwasher appliance of claim 5, wherein the first and second attachment arms each comprise a different attachment location at the second height for the end portions of the second article positioning arm, the different attachment locations each comprising the second recess formed into the inner surface of one of the first and second attachment arms at the second height.

7. The dishwasher appliance of claim 6, wherein the first cutout of each of the first and second recesses extends at an angle with respect to the second cutout of each of the first and second recesses, and wherein the first cutout of each of the first and second recesses intersects the second cutout of each of the first and second recesses.

8. The dishwasher appliance of claim 7, wherein the first and second article positioning arms are each formed of a flexible wire form, wherein, to move the first and second article positioning arms to the engaged position, each of the flexible wire forms is compressed and rotated until the respective end portions of the first and second article positioning arms align with the first cutouts, then the compressed flexible wire forms are released, thereby securing the respective end portions of the first and second article positioning arms within the first cutouts.

9. The dishwasher appliance of claim 8, wherein, to move the first and second article positioning arms to the disengaged position, each of the flexible wire forms is compressed and rotated until the respective end portions of the first and second article positioning arms align with the second cutouts, then the compressed flexible wire form is released, thereby securing the respective end portions of the first and second article positioning arms within the second cutouts.

10. The dishwasher appliance of claim 1, wherein the articles comprise at least one of stemware or one or more water bottles.

11. The dishwasher appliance of claim 10, wherein, in the engaged position, the first and second article positioning arms orient the stemware in a direction away from the side wall of the lower rack such that fluid does not pool atop a base of the stemware during operation of the dishwasher appliance.

12. An article holder assembly for use in a dishwasher appliance, comprising:

a first attachment arm for securing to a first side wall of a rack of the dishwasher appliance;

a second attachment arm for securing to an opposing, second side wall of the rack of the dishwasher appliance; and first and second article positioning arms secured between the first and second attachment arms, the first and second article positioning arms being movable between an engaged position and a disengaged position, wherein the first and second article positioning arms each define a predefined geometry configured to receive a portion of one or more articles for cleaning in the dishwasher appliance, and wherein, when the first and second article positioning arms are at in the engaged position, the predefined geometries position and secure one or more of the articles on the rack of the dishwasher appliance for cleaning, and wherein, when in the disengaged position, the first and second article positioning arms extend in a direction that is generally parallel with the first and second attachment arms such that the first and second article positioning arms and the first and second attachment arms extend in a common two-dimensional plane, and wherein the first and second attachment arms each comprise attachment locations for end portions of the first and second article positioning arms, the attachment locations each comprising a recess formed into an inner surface of the first and second attachment arms at a first height and a second height, respectively, each of the recesses comprising a first cutout extending in a first direction and a second cutout connected to the first cutout and extending in a second direction, the first and second directions being different.

13. The article holder assembly of claim 12, wherein top ends of the first and second attachment arms each comprise a slot configured for sliding onto opposing side walls of the rack of the dishwasher appliance so as to assist with securing the first and second attachment arms in place.

14. The article holder assembly of claim 12, wherein bottom ends of the first and second attachment arms each comprise a female connector configured for securing the first and second attachment arms in place.

15. The article holder assembly of claim 12, wherein the first and second article positioning arms are rotatably mounted between the first and second attachment arms at the first height and the second height, respectively, the second height being lower than the first height.

16. The article holder assembly of claim 15, wherein, in the engaged position, the respective end portions of the first and second article positioning arms are secured in place via the first cutout, and wherein, in the disengaged position, the respective end portions of the first and second article positioning arms are secured in place via the second cutout.

17. The article holder assembly of claim 12, wherein the first cutout of each recess extends at an angle with respect to the second cutout of each recess, and wherein the first cutout of each recess intersects the second cutout of each recess.

* * * * *